US009580284B2

(12) United States Patent
Helmich

(10) Patent No.: US 9,580,284 B2
(45) Date of Patent: Feb. 28, 2017

(54) ELECTRONICALLY CONTROLLED WHEEL LIFT SYSTEM

(71) Applicant: Gray Manufacturing Company, Inc., St. Joseph, MO (US)

(72) Inventor: Seth A. Helmich, Cameron, MO (US)

(73) Assignee: Gray Manufacturing Company, Inc., St. Joseph, MO (US)

( * ) Notice: Subject to any disclaimer, the term of this patent is extended or adjusted under 35 U.S.C. 154(b) by 274 days.

(21) Appl. No.: 13/847,309

(22) Filed: Mar. 19, 2013

(65) Prior Publication Data

US 2013/0240812 A1 Sep. 19, 2013

Related U.S. Application Data

(60) Provisional application No. 61/612,670, filed on Mar. 19, 2012.

(51) Int. Cl.
*B66F 3/46* (2006.01)

(52) U.S. Cl.
CPC ..... *B66F 3/46* (2013.01)

(58) Field of Classification Search
CPC ..... B66F 3/46; B66F 7/04
See application file for complete search history.

(56) References Cited

U.S. PATENT DOCUMENTS

| | | | | |
|---|---|---|---|---|
| 3,595,525 | A * | 7/1971 | Yaste | 254/2 B |
| 4,599,034 | A * | 7/1986 | Kennedy et al. | 414/678 |
| 5,484,134 | A * | 1/1996 | Francis | 254/2 B |
| 5,911,408 | A * | 6/1999 | Berends et al. | 254/2 B |
| 5,954,160 | A * | 9/1999 | Wells et al. | 187/219 |
| 6,315,079 | B1 * | 11/2001 | Berends et al. | 187/210 |
| 6,634,461 | B1 * | 10/2003 | Baker | 187/247 |
| 6,923,599 | B2 * | 8/2005 | Kelso | 405/230 |
| 7,219,770 | B2 * | 5/2007 | Baker | 187/247 |
| 7,500,816 | B2 * | 3/2009 | Berends et al. | 414/458 |
| 8,028,973 | B2 * | 10/2011 | Ford et al. | 254/89 R |
| 8,256,577 | B2 * | 9/2012 | Kritzer | 187/215 |
| 8,567,761 | B2 * | 10/2013 | De Jong et al. | 254/89 R |
| 2004/0037653 | A1 * | 2/2004 | Kelso | 405/236 |
| 2004/0211945 | A1 * | 10/2004 | Maggiori | 254/89 R |

* cited by examiner

*Primary Examiner* — Joseph J Hail
*Assistant Examiner* — Marc Carlson
(74) *Attorney, Agent, or Firm* — Hovey Williams LLP

(57) ABSTRACT

A wheel lift system capable of performing an electronically synchronized lift using two or more individual lifts. In one embodiment, the wheel lift system is pneumatically powered via an external source of compressed air, and the system is electronically controlled from a common control station/module. The common control station/module can include a moveable cart and/or a wireless handheld control module. In one embodiment, each lift of the wheel lift system is connected to a common movable cart and a user control interface is also connected, either physically or wirelessly, to the movable cart.

32 Claims, 11 Drawing Sheets

ELECTRONICALLY CONTROLLED WHEEL LIFT SYSTEM

CROSS-REFERENCE TO RELATED APPLICATIONS

This application claims priority to U.S. Provisional Patent Application Ser. No. 61/612,670, filed Mar. 19, 2012, the entire disclosure which is incorporated herein by reference to the extent it does not contradict statements contained herein.

BACKGROUND OF THE INVENTION

1. Field of Invention

The present invention relates generally to vehicle lifts and stands. More particularly, certain embodiments of the present invention relate to pneumatically powered vehicle lifts that employ dual mechanical locking mechanisms for enhanced safety when a vehicle is being held in a raised position.

2. Discussion of the Prior Art

The maintenance of vehicles such as cars and trucks frequently requires access to the underside of the vehicles in order to permit repair of parts such as transmissions, clutches, gearing, joints, brakes, and the like. In order to reach these areas of a vehicle, a worker typically employs one or more lifting devices that are positioned beneath the vehicle chassis or wheels and actuated to lift the vehicle above the ground.

Once the vehicle has been raised to a desired height for carrying out the desired maintenance, stands are commonly positioned beneath the vehicle to support it during the repairs, and the lifting devices are removed. The stands are used in place of the lifting devices because of the added support provided by such stands, and because such stands do not allow inadvertent upward or downward shifting of the vehicle.

U.S. Pat. No. 5,484,134 discloses pneumatic lifts that also function as support stands to hold a vehicle in a lifted position while it is being worked on. The entire disclosure of the '134 patent is incorporated herein by reference. Although, the lift system of the '134 represents a significant advancement in automotive wheel lifts, the system of the '134 patent is configured to raise and hold one end of a vehicle at a time. Further, the system requires manual level control during raising and lowering.

SUMMARY OF THE INVENTION

The vehicle lift system described herein can, in certain embodiments, provide one or more of the following benefits: (1) permit simultaneously lifting of both ends of a vehicle, (2) automatically maintain all lifts at substantially the same lifting height during lifting and lowering, (3) reduce time involved in operating lifts by allowing complete operation of all the lifts from one location, (4) employ inexpensive, safe, and reliable pneumatic power to lift the vehicle, and (5) permit pneumatic lifts to be used as support stands while both ends of the vehicle are raised.

In one embodiment of the present invention, there is provided a wheel-engaging pneumatic lift system for lifting a vehicle relative to the ground using compressed air from an external source. The lift system includes at least on a pair of pneumatic lifts. Each of the pneumatic lifts has a base assembly for supporting the pneumatic lift on the ground, a cradle assembly for engaging a wheel of the vehicle, a pneumatic system comprising a pneumatically powered actuator for selectively raising the cradle assembly relative to the base assembly, and an electronic control system. The electronic control system includes a wireless communication device and a position indicator for providing an indication of the vertical position of the cradle assembly. The lift system also includes a wireless handheld control module configured for two-way wireless communication with the wireless communication devices of the pneumatic lifts. The wireless handheld control module is configured to wirelessly control raising and lowering of the pneumatic lifts.

In another embodiment of the present invention, there is provided a wheel-engaging pneumatic lift system for lifting a vehicle relative to the ground using compressed air from an external source, where the lift system includes a pair of pneumatic lifts, each having a base assembly for supporting the pneumatic lift on the ground, a cradle assembly for engaging a wheel of the vehicle, and a pneumatically powered actuator for selectively raising the cradle assembly relative to the base assembly. The lift system also includes a lift control system for controlling the pneumatic lifts. The lift control system includes a position indication system for providing an indication of the absolute and/or relative vertical positions of the cradle assemblies, a pneumatic power control system for controlling the supply of compressed air from the external source to the pneumatic lifts, and an electronic control system for controlling the pneumatic power control system based on the indication of vertical position provided by the position indication system.

In still another embodiment of the present invention, there is provided wheel-engaging pneumatic lift system for lifting a vehicle relative to the ground using compressed air from an external source, where the lift system includes a pair of pneumatic lifts, each including a base assembly for supporting the pneumatic lift on the ground, a cradle assembly for engaging a wheel of the vehicle, and a pneumatically powered actuator for raising the cradle assembly relative to the base assembly. The lift system also includes a manually-coordinating lift control system for controlling the pneumatic lifts without the use of electronic controls and an automatically-coordinating lift control system for controlling the pneumatic lifts using electronic controls. The pneumatic lifts are capable of operating in either a manual mode of operation or an automatic mode of operation. When the pneumatic lifts are in the manual mode of operation, the lifts are controlled by the manually-coordinating lift control system. When the lifts are in the automatic mode of operation, the lifts are controlled by the automatically-coordinating lift control system.

In yet another embodiment of the present invention, there is provided a wheel-engaging lift system for lifting a vehicle relative to the ground, where the lift system includes a pair of lifts, each having a base assembly for supporting the lift on the ground, a cradle assembly for engaging a wheel of the vehicle, and an actuator for selectively raising the cradle assembly relative to the base assembly. The lift system also includes a lift control system for controlling the lifts. The lift control system includes a position indication system for providing an indication of the vertical positions of each cradle assembly, an actuator control system for controlling the actuator of each lift, and an electronic control system for controlling the actuator control system based on the indication of vertical positions provided by the position indication system. The lift control system includes a movable cart and a handheld control module. The cart is not rigidly coupled to the lifts and the handheld control module is not rigidly coupled to the lifts or the control module. At least a portion of the lift control system is located on the cart and at least a portion of the lift control system is located in the handheld control module.

DETAILED DESCRIPTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
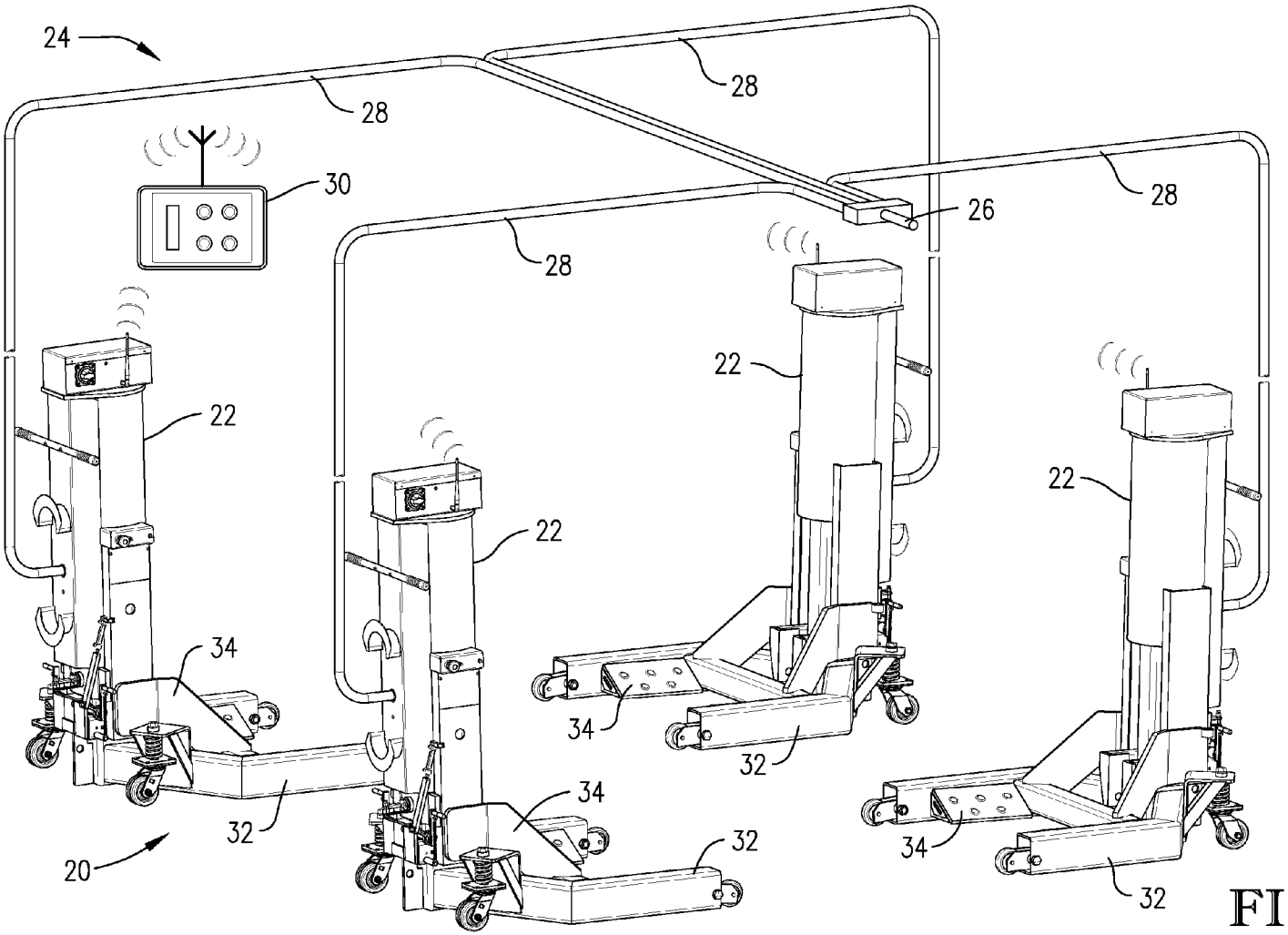
FIG. 1 shows a pneumatic lift system having four individual pneumatic lifts that receive compressed air from an overhead air distribution system and are controlled via a wireless handheld control module.

FIG. 1 illustrates a wheel-engaging pneumatic lift system 20 having four individual pneumatic lifts 22 that receive compressed air from an overhead air distribution system 24. Compressed air from an external source can be supplied to the overhead air distribution system 24 via a supply line 26. The air in the supply line 26 can be split among distribution lines 28, which each supply compressed air to a respective one of the pneumatic lifts 22. Although FIG. 1 depicts two pair of pneumatic lifts 22, it should be noted that a single pair of pneumatic lifts 22 can be use to lift one end of a vehicle, while the other end remains on the ground. Further, for vehicles with more than four wheels, the pneumatic lift system 20 can include three or more pairs of pneumatic lifts 22 to match the total number of axles on the vehicle.

The pneumatic lift system 20 depicted in FIG. 1 includes a wireless handheld control module 30 for controlling all or part of the functions of the individual pneumatic lifts 22. For example, the wireless handheld control module 30 can control raising, parking, and/or lowering of all of the pneumatic lifts 22 of the lift system 20.

The wireless handheld control module 30 can include a circuit board and/or programmable logic controller (PLC) for processing information relating to the lifting operation. The wireless handheld control module 30 can also include one or more rechargeable batteries. The wireless handheld control module 30 can be configured to accept user input through the use of contact switches, a touch screen display, and/or voice actuation. The wireless handheld control module 30 can include a display for providing information about the pneumatic lifts 22 to the operator of the lift system 20. The display can be, for example, a liquid crystal display (LCD) or a touch screen display that displays various instructions and/or prompts for the operator of the pneumatic lift system 20 to follow during setup and operation. The wireless handheld control module 30 can be configured for two-way wireless communication (e.g., via a radio frequency transceiver) with each of the pneumatic lifts 22.

As shown in FIG. 1, each pneumatic lift 22 can include a base assembly 32 and a cradle assembly 34 that is vertically shiftable relative to the base assembly 32. The base assembly 32 is configured to support the pneumatic lift 22 on the ground. The cradle assembly 34 is configured to engage the tires of a vehicle to be lifted by the pneumatic lift 22. Each lift 22 can include a pneumatic system having a main pneumatically powered actuator/cylinder (not shown in FIG. 1) for selectively raising the cradle assembly 34 relative to the base assembly 32, so that the wheels of the vehicle supported on the cradle assemblies 34 of the pneumatic lift system 20 are lifted off the ground. Each of the cradle assemblies 34 can include wheel engaging surfaces presenting a plurality of protrusions capable of gripping the tires of a vehicle.

The pneumatic lift system 20 can be equipped with an electronic system that includes a position indication system (not shown in FIG. 1) configured to provide an indication of the absolute and/relative vertical position of the cradle assemblies 34. The position indication system can include a position detection device such as, for example, an electronic limit switch system, an electronic height sensor, and an electronic level. Examples of suitable height sensors include distance sensing laser emitting devices and string potentiometers. In certain embodiments, the position detection device is directly coupled to the pneumatic lift 22. In other embodiments, the position detection device is not directly coupled to the pneumatic lift 22, but can be attached to the vehicle being lifted. When an electronic level is used, it can include an accelerometer and can be configured for attachment the vehicle being lifted.

The electronic system of each pneumatic lift 22 can also include a wireless communication device configured to transmit wireless signals to the wireless handheld control module 30. The signals received by the wireless handheld control module 30 can include vertical position information provided by the position indication system. This allows the absolute or relative vertical position of each pneumatic lift 22 to be tracked and controlled in real time.

The circuit board and/or PLC associated with the wireless handheld control module 30 can include a memory and a processor programmed to receive vertical position information about the pneumatic lifts 22 and then automatically control the individual pneumatic lifts 22 in a manner such that the base assemblies base assembly 32 of each of the pneumatic lifts 22 are maintained at substantially similar heights during raising and/or lowering of a vehicle. Such coordinate/synchronize lifting, enables pneumatic lifts 22 to perform a full vehicle lift (both front and back), in contrast to prior pneumatic lift systems, which could only safely lift one end of a vehicle at a time.

Figure 2:
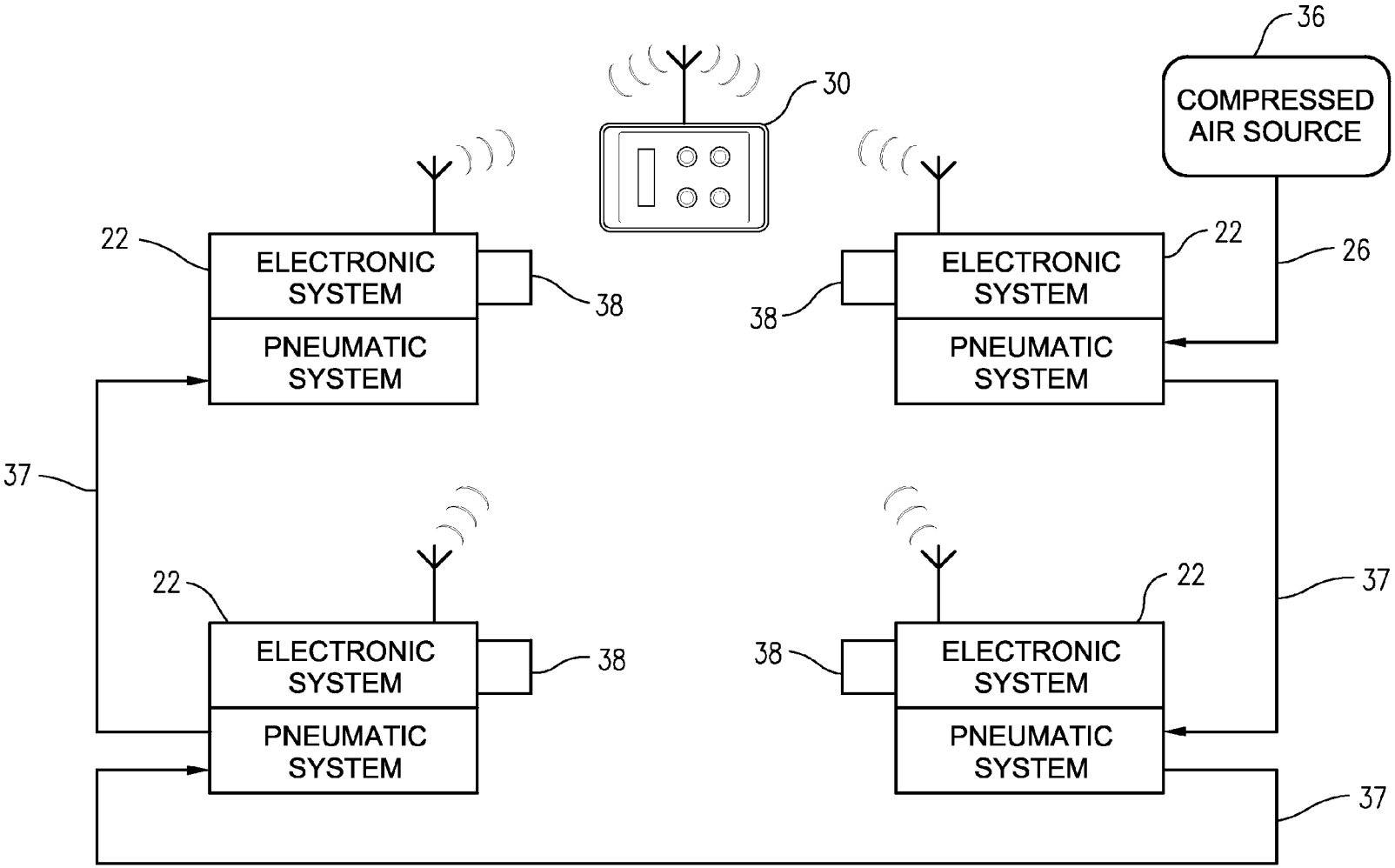
FIG. 2 is a simplified depiction of a pneumatic lift system having four individual pneumatic lifts that receive compressed air via serially connected distribution lines, particularly illustrating that each lift has an electronic system that includes a vertical position indicator/sensor.

FIG. 2 provides a simplified representation of an alternatively configured pneumatic lift system 20, where a compressed air source 36 provides compressed air via a supply line 26 to a first one of the pneumatic lifts 22. The compressed air supplied to the first one of the pneumatic lifts 22 can then be distributed to the other pneumatic lifts 22 via a plurality of serially-connected distribution lines 37. FIG. 2 also shows that each pneumatic lift 22 includes an electronic system and a pneumatic system that interact with one another to allow for coordinated/synchronized control of all the pneumatic lifts 22 via the wireless handheld control module 30. The electronic system of each lift is shown in FIG. 2 as including a position indicator 38 for providing an indication of the height of the individual pneumatic lift 22 with which the position indicator 38 is associated.

Figure 3:
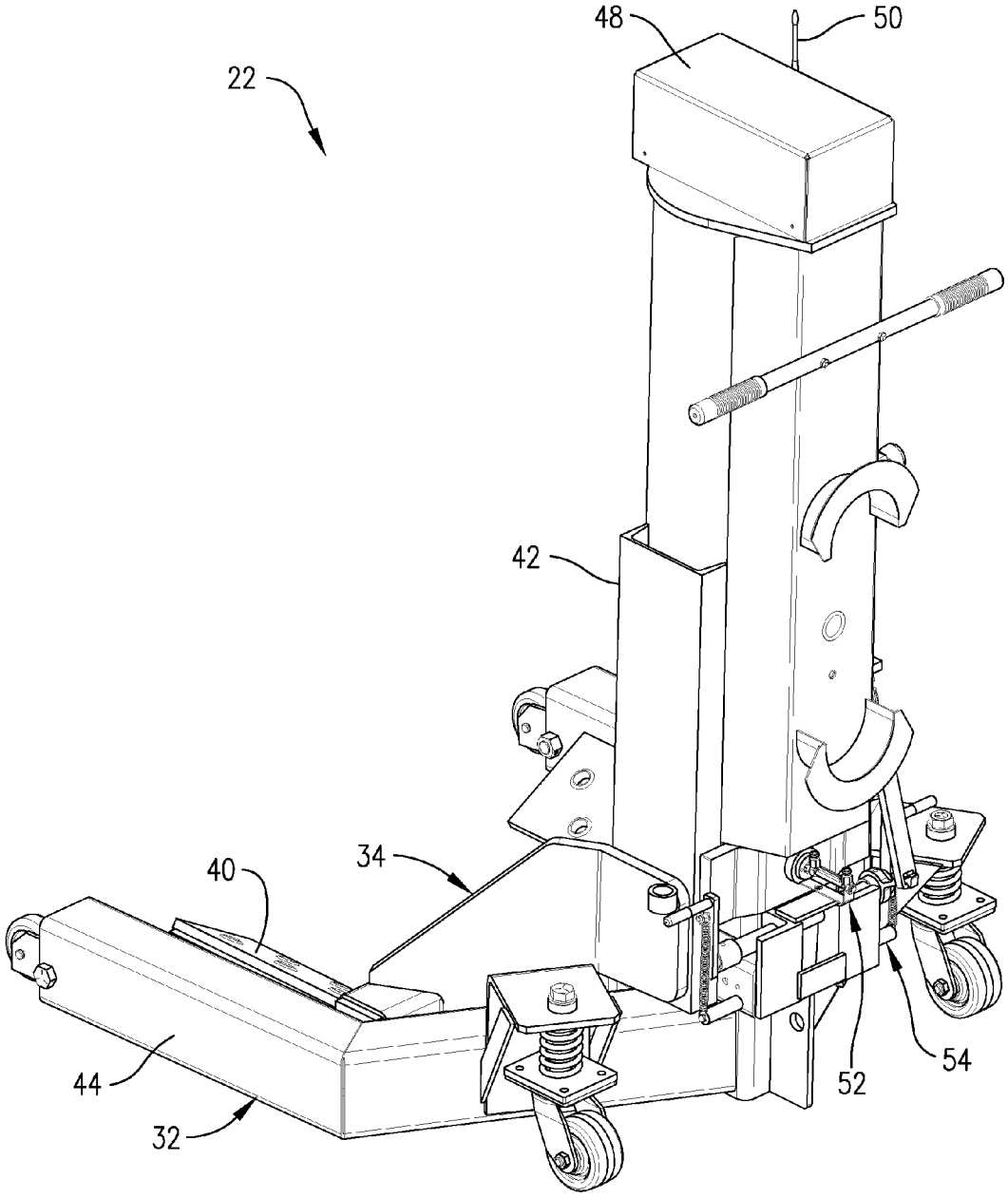
FIG. 3 is an isometric view of one of the pneumatic lifts of the system depicted in FIG. 1, where the lift includes a base assembly, a cradle assembly shiftable relative to the base assembly, a mechanical downstop system, and a mechanical height locking system.
Figure 4:
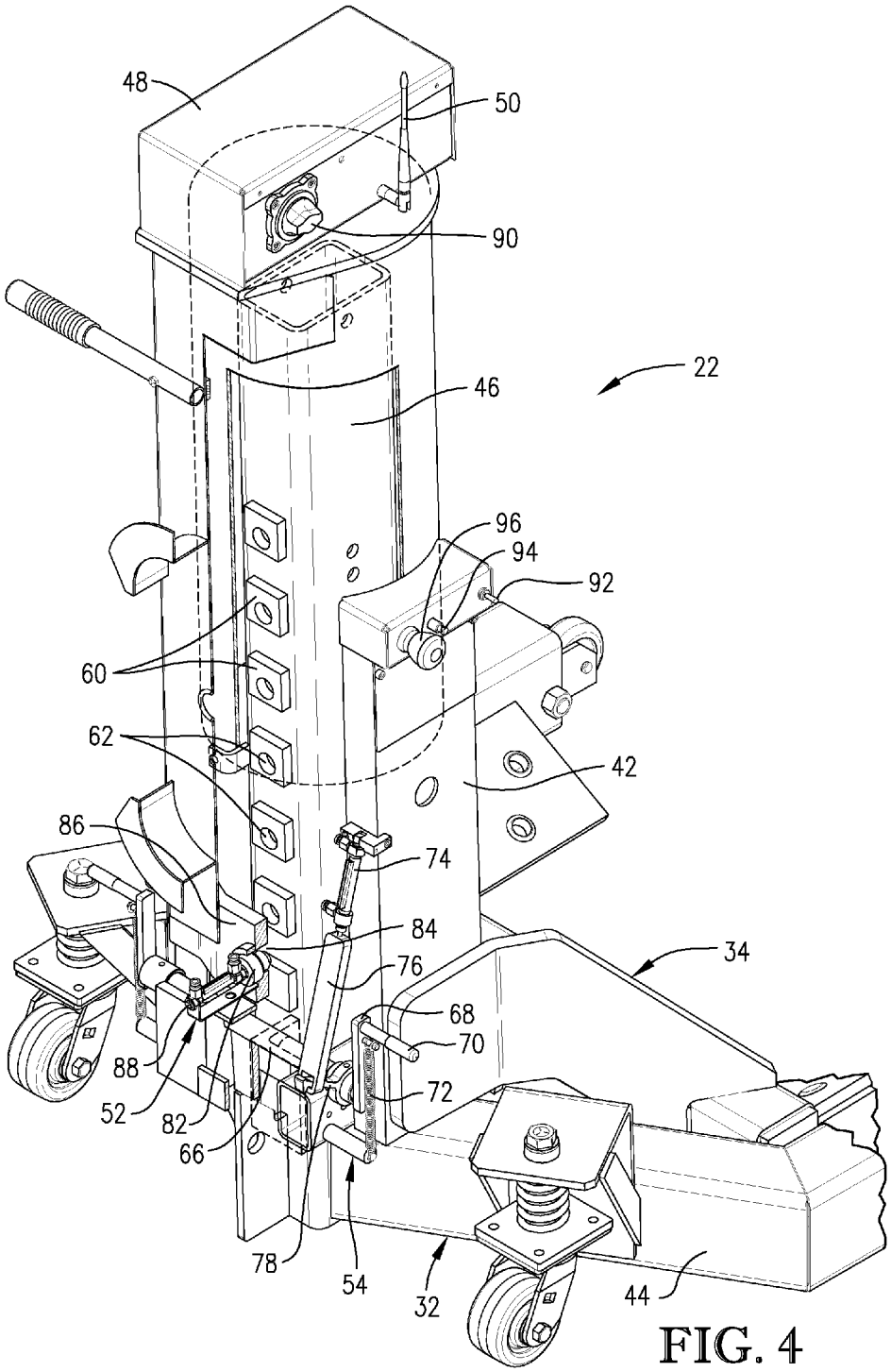
FIG. 4 is an isometric view of the lift of FIG. 3, with certain portions of the lift being cut away to better view the lift's downstop and height locking systems.

FIGS. 3-7 provide enlarged views of a single pneumatic lift 22 suitable for use in the pneumatic lift systems pneumatic lift system 20 depicted in FIGS. 1 and 2. FIGS. 3 and 4 show that the cradle assembly 34 of the pneumatic lift 22 can include a lower wheel-engaging section 40 and a upper post-receiving section 42, while the base assembly 32 of the pneumatic lift 22 can include a ground engaging support 44 and a upright post 46 (FIG. 4). As shown in FIG. 3, the pneumatic lift 22 can include an electronics enclosure 48 coupled to the upper section 42 of the cradle assembly and configured to house at least a portion of the electronic system of the pneumatic lift 22. The portion of the electronic system housed in the enclosure 48 can include, for example, a rechargeable battery, a wireless transceiver, a circuit board, and/or PLC. An antenna 50 can be attached to the pneumatic lift 22 to facilitate two-way wireless communication with other pneumatic lifts 22 of the system and/or with a wireless handheld control module, as discussed above.

Referring again to FIG. 3, the pneumatic lift 22 can include an automatic height locking system 52 for selectively preventing vertical movement of the cradle assembly 34 relative to the base assembly 32. When engaged in a locked/parked configuration, the height locking system 52 allows the pneumatic lift 22 to function like a stand, to support a raised vehicle so it can be safely worked on. The pneumatic lift 22 can also include an automatic downstop system 54 for selectively inhibiting unrestricted downward movement of the cradle assembly 34 relative to the base assembly 32. In one embodiment, the downstop system 54 comprises a pawl and ratchet assembly. In certain embodiments of the present invention, one or both of the height locking system 52 and the downstop system 54 can be wirelessly controlled by a common control unit/module, such as the wireless handheld control module 30 discussed above with reference to FIGS. 1 and 2.

Figure 5:
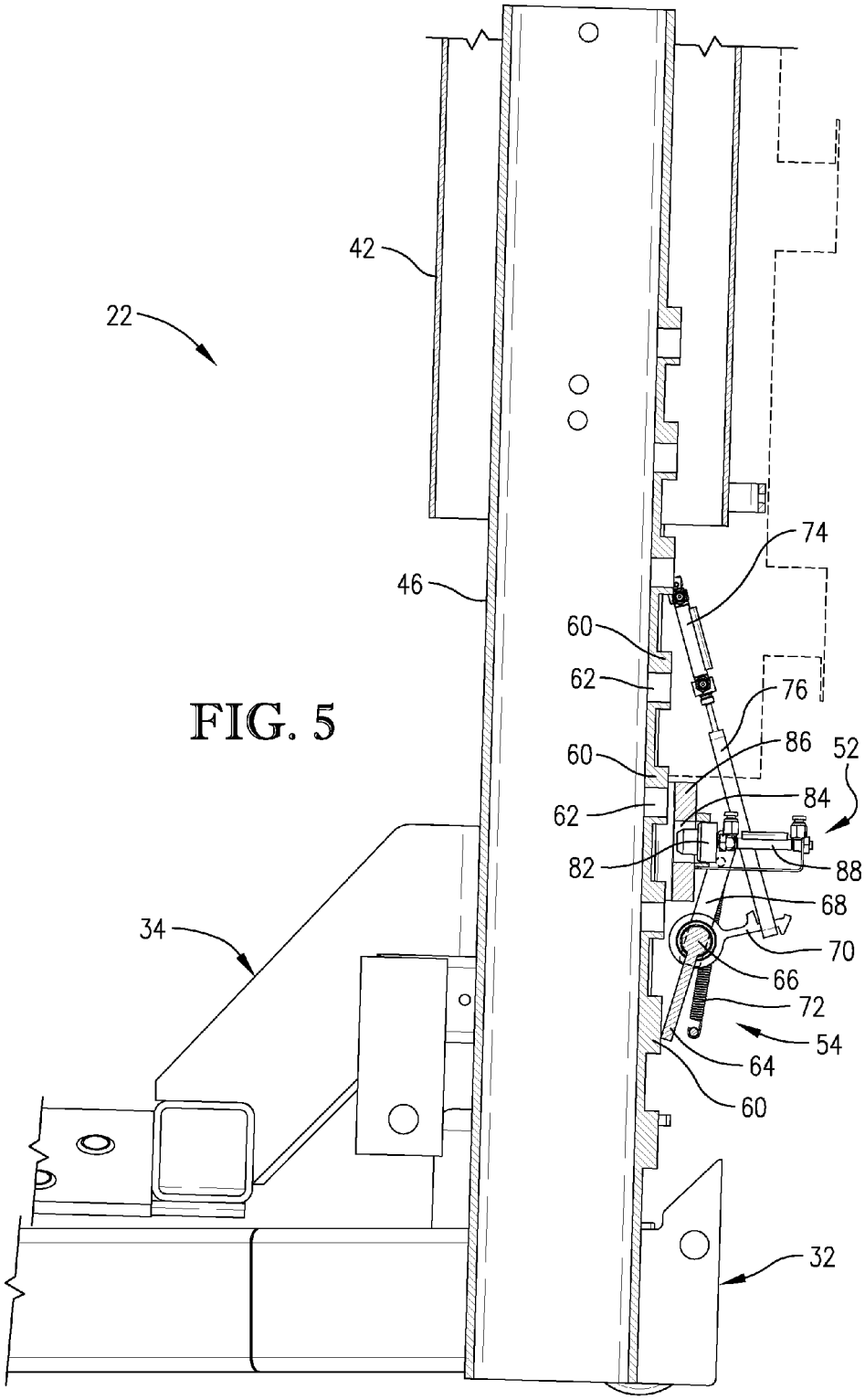
FIG. 5 is a partial side sectional view of the lift of FIG. 3, particularly illustrating the lift in a raising configuration.

Referring now to FIGS. 4 and 5, the individual components of the pneumatic lift 22 will now be described in greater detail. The upright post 46 of the base assembly 32 can include a plurality of vertically-spaced downstop lugs 60 and a plurality of vertically-spaced locking holes 62. The downstop system 54 includes a downstop pawl 64 coupled to the upper post-receiving section 42 of the cradle assembly 34 and configured to engage the downstop lugs 60 and the side of the upright post 46 as the cradle assembly 34 moves upward relative to the upright post 46.

The downstop pawl 64 is fixed to a pivoting pawl support member 66. Both the downstop pawl 64 and the pawl support member 66 can be pivoted relative to the cradle assembly 34 on a substantially horizontal pivot axis. The downstop system 54 also includes a manual pivot arm 68 coupled to the pivoting pawl support member 66. A downstop handle 70 is coupled to the manual pivot arm 68 at a location spaced from where the pivoting pawl support member 66 is connected to the manual pivot arm 68. The downstop handle 70 allows the downstop pawl 64 to be manually shifted into and out of engagement with the downstop lug 60. A downstop spring 72 is also coupled to the manual pivot arm 68 at a location spaced from where the pivoting pawl support member 66 is connected to the manual pivot arm 68. The downstop spring 72 biases the terminal end of the downstop pawl 64 into engagement with the upright post 46 and the downstop lugs 60, thereby maintaining engagement of the downstop pawl 64 with the upright post 46 and the downstop lugs 60 when the cradle assembly 34 is raised relative to the base assembly 32.

The downstop system 54 also includes a downstop actuator 74 and an actuator linkage 76 for connecting the downstop actuator 74 to an automatic pivot arm 78. The automatic pivot arm 78 is coupled to the pivoting pawl support member 66 so that translational movement of the automatic pivot arm 78 causes rotational movement of the pivoting pawl support member 66, thereby shifting the downstop pawl 64. The downstop actuator 74 can be a pneumatic actuator powered by compressed air from the same source as the compressed air used to raise the cradle assembly 34 relative to the base assembly 32. In the embodiment depicted in FIGS. 4 and 5, the downstop actuator 74 is a two-way pneumatic cylinder that, when actuated, shifts the terminal end of the downstop pawl 64 either toward or away from the upright post 46. As discussed in further detail below, the downstop actuator 74 can be electronically controlled via any suitable means such as, for example, a solenoid and an electronic control system with which the solenoid communicates. The downstop actuator 74 can include a position sensor that communicates the position of the downstop actuator 74 to the electronic control system so the electronic control system knows whether the downstop system 54 is engaged or disengaged.

As shown in FIGS. 4 and 5, the height locking system 52 can include a locking pin 82 that is received in a locking pin opening 84 formed in a rigid support member 86 of the cradle assembly 34. The height locking system 52 can also include a locking pin actuator 88 for shifting the locking pin 82 relative to the rigid support member 86. The locking pin 82 can include a first (narrower) portion sized for close-fitting receipt in the locking hole 62 of the upright post 46. The locking pin 82 can also include a second (broader) portion sized for close-fitting receipt in the locking pin opening 84 of the rigid support member 86.

The locking pin actuator 88 is configured to shift the height locking system 52 between a parked/locked configuration and an unlocked configuration. When the height locking system 52 is in the locked configuration the first (narrower) portion of the locking pin 82 is received in one of the locking holes 62 of the upright post 46 and the second (broader) portion of the locking pin 82 is received in the locking pin opening 84 of the rigid support member 86. In this locked configuration, the locking pin 82 prevents vertical shifting of the rigid support member 86 relative to the upright post 46, thereby also preventing raising and lowering of the cradle assembly 34 relative to the base assembly 32. Thus, the locking pin actuator 88 can shift the height locking system 52 from the locked/parked configuration to the unlocked configuration by simply removing locking pin 82 from the locking hole 62 within which it was received. With the locking pin 82 removed from the locking hole 62, vertical shifting of the cradle assembly 34 relative to the base assembly 32 is not inhibited by the height locking system 52.

The locking pin actuator 88 can have a substantially similar configuration as the downstop actuator 74, described above. Thus, the locking pin actuator 88 can be a pneumatic actuator powered by compressed air from the same source as the compressed air used to raise the cradle assembly 34 relative to the base assembly 32. In one embodiment, the locking pin actuator 88 is a two-way pneumatic cylinder that can be electronically controlled via a solenoid that communicates with the pneumatic lift's 22 electronic control system. The locking pin actuator 88 can include a position sensor that communicates the position of the locking pin 82 to the electronic control system of the pneumatic lift 22 so the electronic control knows whether the height locking system 52 is the locked/parked configuration or the unlocked configuration.

In certain embodiments of the present invention, the locking pin actuator 88 and/or the downstop actuator 74 may be activated using a wireless handheld control module, such as the control module described above with reference to FIGS. 1 and 2. The control module may have dedicated input devices for directly activating the locking pin actuator 88 and/or the downstop actuator 74. Alternatively, the locking pin actuator 88 and/or the downstop actuator 74 may be indirectly activated from control module by utilizing a program that automatically activates the locking pin actuator 88 and/or the downstop actuator 74 when certain commands are provided via the control module. For example, the electronics of the lift system may be programmed such that a "lower" command inputted at the control module may (1) automatically activate the locking pin actuator 88 to shift the locking pin 81 into the unlocked position and (2) automatically activate the downstop actuator 74 to shift the downstop pawl 64 into the disengaged position.

Figure 6:
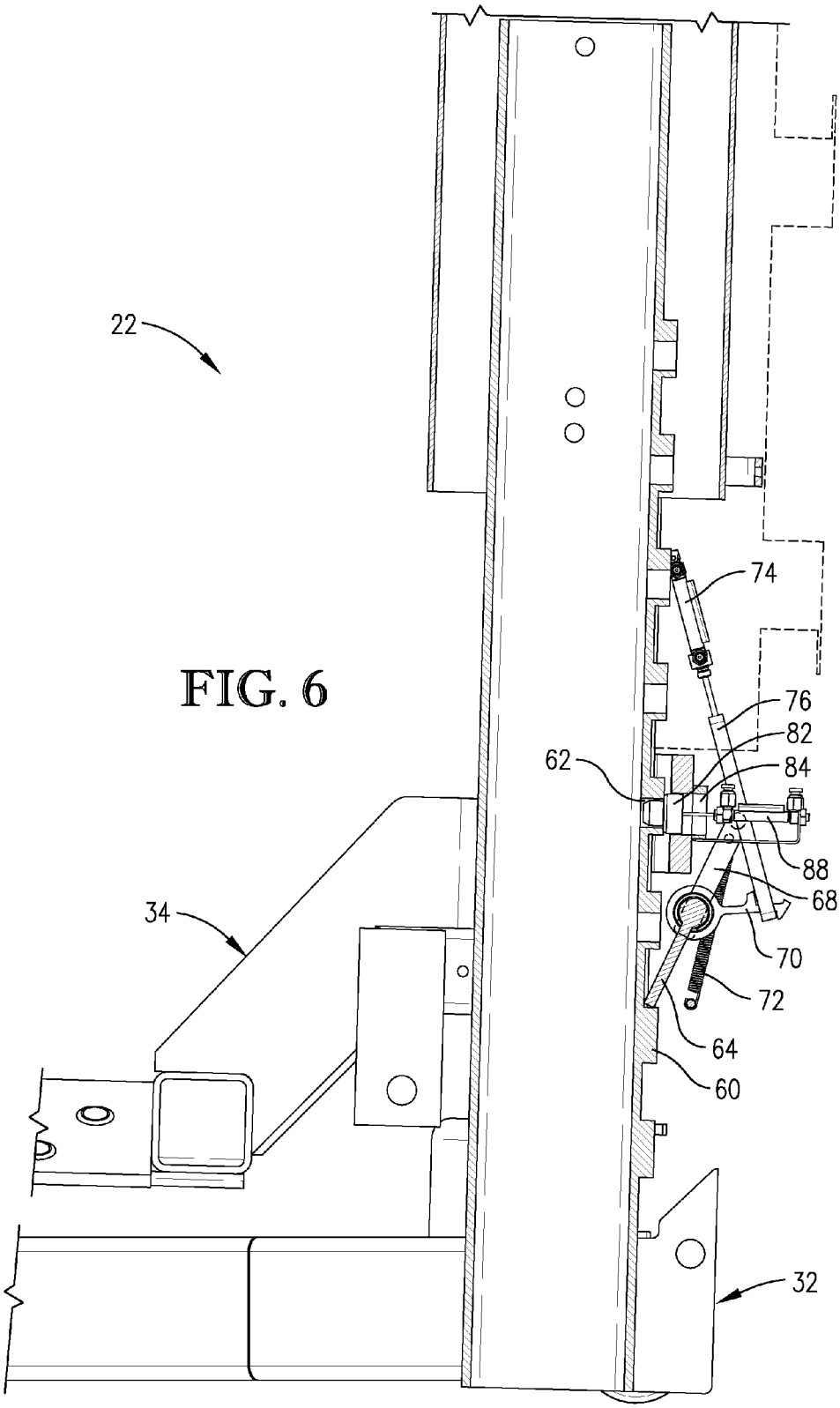
FIG. 6 is a partial side sectional view of the lift of FIG. 3, particularly illustrating the lift in a locked configuration.
Figure 7:
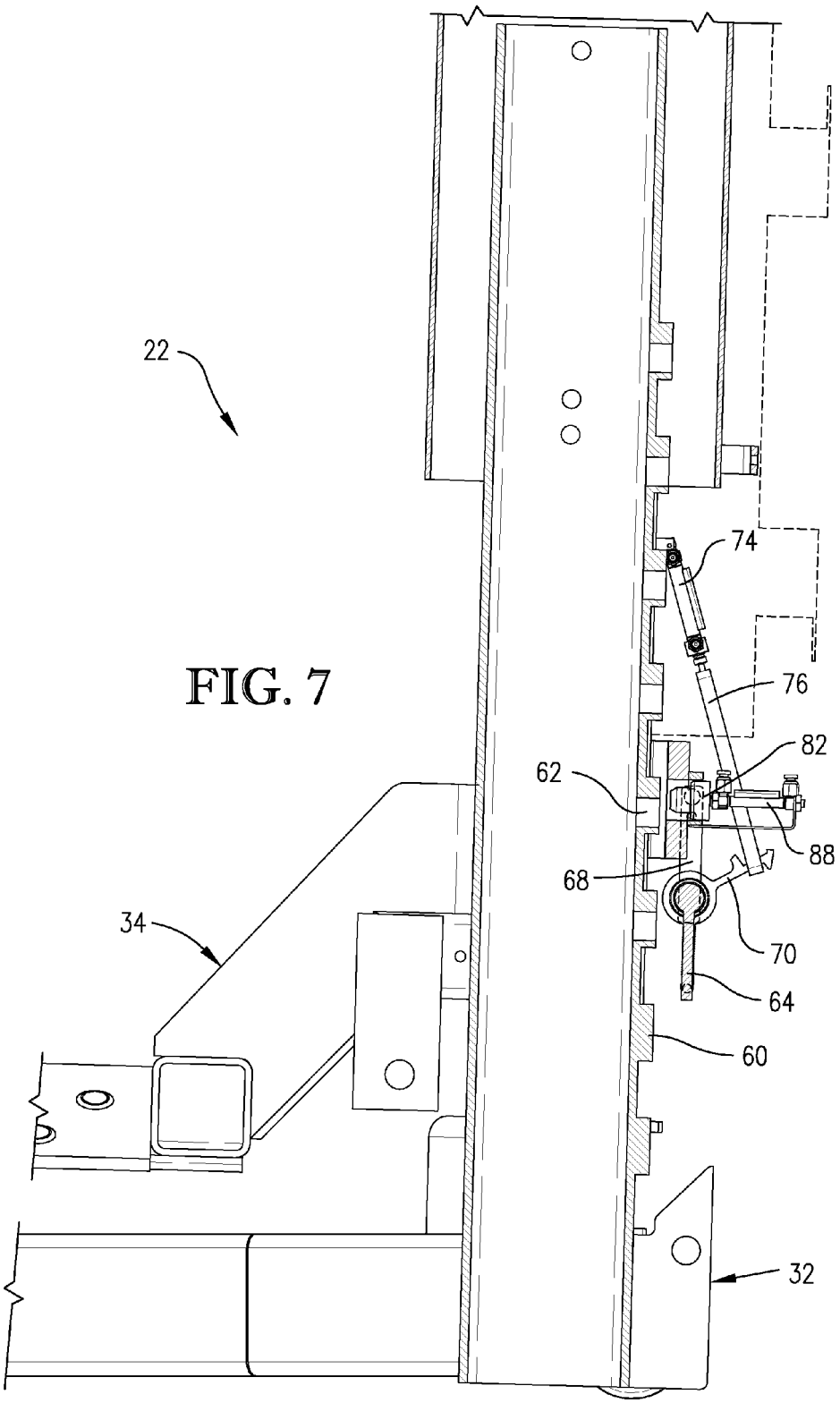
FIG. 7 is a partial side sectional view of the lift of FIG. 3, particularly illustrating the lift in a lowering configuration.

FIGS. 5-7 illustrate the height locking system 52 and the downstop system 54 in various positions/configurations that are experience during normal operation of the pneumatic lift 22 to raise, park, and lower a vehicle. FIG. 5 depicts the lift 22 in a raising configuration. During raising of the cradle assembly 34 relative to the base assembly 32, the height locking system 52 is in the unlocked configuration, with the locking pin 82 being removed from the locking holes 62 of the upright post 46. Also, during raising of the cradle assembly 34 relative to the base assembly 32, the downstop system 54 is in an engaged configuration, where the downstop spring 72 holds the downstop pawl 64 into engagement with the side of the upright post 46 and the downstop lugs 60. As the cradle assembly 34 rises relative to the upright post 46 of the base assembly 32, the terminal end of the downstop pawl 64 travels up the side of the upright post 46, passing over each of the downstop lugs 60 along the way. When the cradle assembly 34 reaches the desired height, the electronic control system of the pneumatic lift 22 automatically lowers the cradle assembly 34 until the terminal end of the downstop pawl 64 engages the upper surface of the next lower downstop lug 60. Once the terminal end of the downstop pawl 64 is resting on the upper surface of one of the downstop lugs 60, the cradle assembly 34 can no longer shift downwardly relative to the upright post 46. Additionally, once the terminal end of the downstop pawl 64 is resting on the upper surface of one of the downstop lugs 60, the locking pin 82 is aligned for insertion into one of the locking holes 62 on the upright post 46. At this point, the height locking system 52 can be shifted into the parked/locked configuration by the locking pin actuator 88.

FIG. 6 depicts the pneumatic lift 22 in a parked/locked configuration, with the locking pin 82 being inserted into one of the locking holes 62 on the upright post 46. In the parked/locked configuration, the terminal end of the downstop pawl 64 is also held in engagement with the top surface of one of the downstop lugs 60. Thus, when the pneumatic lift 22 is in the locked configuration, downward movement of the cradle assembly 34 relative to the base assembly 32 is prevented by two mechanical lock mechanisms, the height locking system 52 and the downstop system 54.

FIG. 7 depicts the pneumatic lift 22 in a lowering configuration, with the height locking system 52 being unlocked and the downstop system 54 being disengaged. In order to shift the lift from the locked configuration show in FIG. 6 to the lowering configuration shown in FIG. 7, the following steps are carried out: (1) the locking pin actuator 88 shifts the height locking system 52 from the locked configuration to the unlocked configuration by removing the locking pin 82 from the locking hole 62; (2) main cylinder of the pneumatic lift 22 slightly raises the cradle assembly 34 relative to the upright post 46 until the terminal end of the downstop pawl 64 is vertically spaced from the top surface of the downstop lug 60 upon which it was resting; (3) the downstop actuator 74 shifts the downstop system 54 from the engaged configuration to the disengaged configuration where the terminal end of the downstop pawl 64 is spaced from the upright post 46 and the downstop lugs 60. Once the pneumatic lift 22 is in the lowering configuration, the cradle assembly 34 can be lowered relative to the base assembly 32. After the cradle assembly 34 has been lowered to the desired level, the pneumatic lift 22 can be shifted back in the raising configuration, shown in FIG. 5, by simply using the downstop actuator 74 to shift the downstop pawl 64 back into the engaged configuration.

Referring back to FIG. 4, the pneumatic lift 22 can be equipped with manual controls for turning on, raising, lowering, and stopping the pneumatic lift 22. For example, the pneumatic lift 22 and include a manual main power switch 90, a manual raise/lower switch 92, a manual hold-to-run switch 94, and a manual emergency stop (E-stop) switch 96. The pneumatic lift 22 can be manually turned on by activating the main power switch 90. The pneumatic lift 22 can be manually raise by pressing and holding the hold-to-run switch 94 and simultaneously shifting the raise/lower switch 92 to the raise position. The pneumatic lift 22 can be lowered by pressing and holding the hold-to-run switch 94 and simultaneously shifting the raise/lower switch 92 to the lower position. This manual raising and lowering of the pneumatic lift 22 can be performed independently of any common electronic control unit/module of the lift system.

Referring again to FIG. 4, in the case of an emergency situation, the pneumatic lift 22 can be stopped by manually activating the E-stop switch 96. When the E-stop switch 96 is actuated, the electronic system of the pneumatic lift 22 sends out a signal that stops all other lifts in the system. Such an E-stop signal can be transmitted wirelessly by the activated lift and received direct by all other lifts. Alternatively, the E-stop signal can be transmitted wirelessly to a wireless handheld control module that then wireless communicates a universal stop signal to all the lifts in the system.

Figure 8:
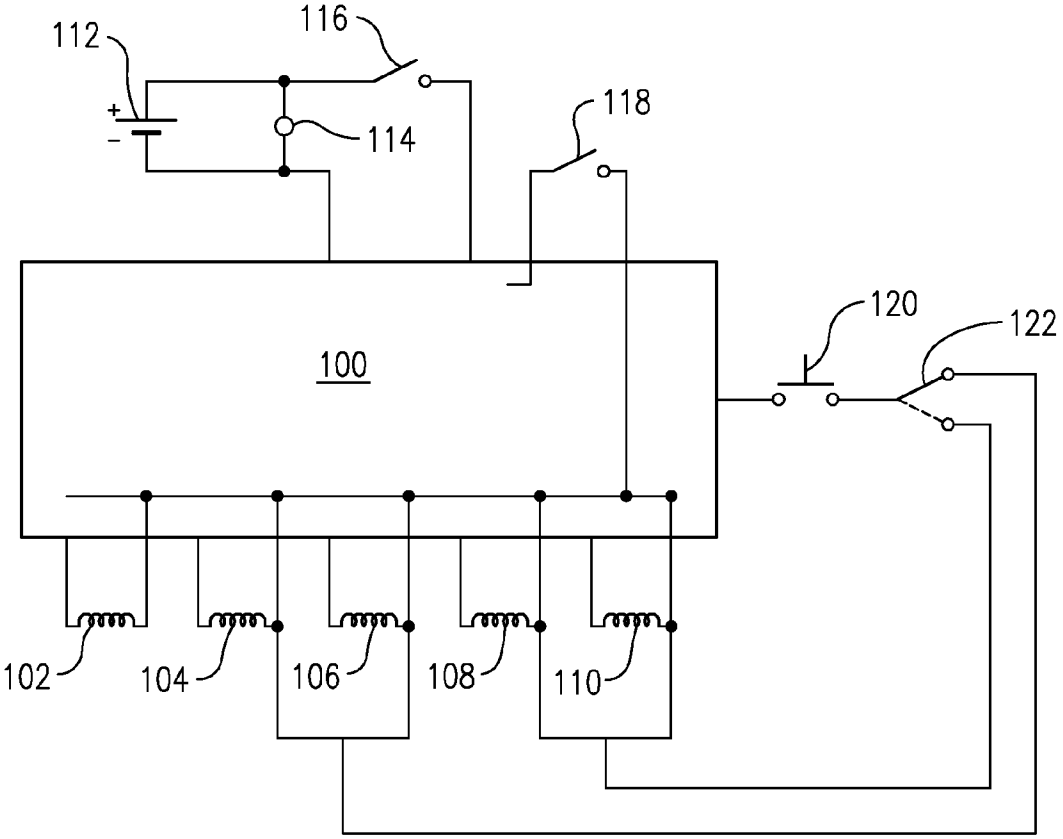
FIG. 8 is a schematic electrical diagram of the portion of the lift's electronic system that controls the lift's pneumatic actuators.
Figure 9:
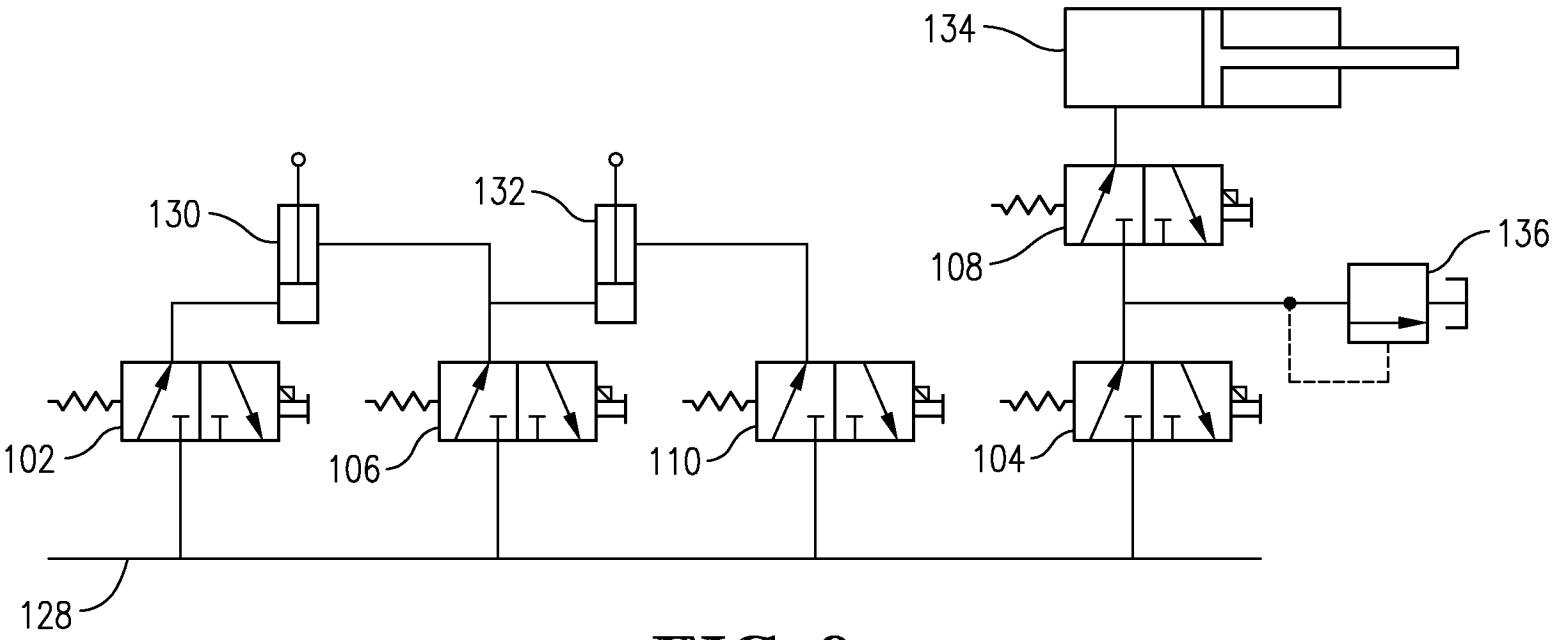
FIG. 9 is a schematic pneumatic diagram showing how the lift's electronically controlled pneumatic actuators provide for automatic control of various function of the lift.

FIGS. 8 and 9 provide schematic electrical (FIG. 8) and pneumatic (FIG. 9) diagrams illustrating how the electrical control system of each lift interacts with the pneumatic control system of each lift. The interaction between the electrical control system and the pneumatic control system allows the various functions of each pneumatic lift in the system to be electronically controlled from a common control unit/module.

FIG. 8 is a partial depiction of an electronic control system of a pneumatic lift configured in accordance with certain embodiments of the present invention. FIG. 8 does not show a processor, a vertical position indicator, and/or a wireless communication device; however, it should be noted that such components can also be part of the electronic control system of each lift. As shown in FIG. 8, the portion of the electronic control system that controls the pneumatic system of the lift can include a lift circuit board 100, a locking pin engage valve 102, a raise valve 104, a downstop engage valve 106, a lower valve 108, and a downstop engage valve 110. Each of these pneumatic valves includes a solenoid that, when energized by the lift circuit board 100, shift the pneumatic valve into a different configuration. This allows the pneumatic valves to be electronically controlled from a common control unit/module that communicates with the lift circuit board 100. FIG. 8 also shows other components of the electronic system, including a rechargeable battery 112, a charger jack 114, a main power switch 116, a E-stop switch 118, a manual hold-to-run switch 120, and a manual raise/off/lower toggle switch 122.

FIG. 9 shows various components of the pneumatic control system of a pneumatic lift configured in accordance with certain embodiments of the present invention. The pneumatic control system includes the pin engage valve 102, the raise valve 104, the downstop engage valve 106, the lower valve 108, and the downstop engage valve 110. As depicted in FIG. 9, each of these valves can be a three-way pneumatic valve actuated by the corresponding solenoid depicted FIG. 8. Referring again to FIG. 9, the pneumatic control system can also include a compressed air supply line 128, a locking pin actuator 130, a downstop actuator 132, a main lift cylinder 134, and a pressure relief valve 136.

Interaction of the electronic and pneumatic control systems will now be described in more detail with reference to both FIGS. 8 and 9. When the lift circuit board 100 simultaneously energizes the solenoid of the raise valve 104 and the solenoid of the lower valve 108, air is allowed into the main lift cylinder 134, thereby causing the lift to rise. When the lift circuit board 100 energizes the solenoid of the lower valve 108, air is allowed to exhaust from the main lift cylinder 134 via the pressure relief valve 136, thereby allowing the lift to lower. When the lift circuit board 100 energizes the solenoid of the downstop engage valve 106, the downstop actuator 132 extends to engage the downstop pawl to the lift's post and the locking pin actuator 130 retracts to disengage the locking pin from the locking pin holes in the lift's post. When the lift circuit board 100 energizes the solenoid of the downstop engage valve 110*b*, the downstop actuator 132 retracts to disengage the down stop pawl from the lift's post. When the lift circuit board 100 energizes the solenoid of the pin engage valve 102*b*, the locking pin actuator 130 extends to insert the locking pin into the locking pin holes on the lift's post.

When simultaneous actuation of the manual hold-to-run switch 120 and the raise side of the manual raise/off/lower toggle switch 122 occurs, the solenoids of the raise valve 104*b*, lower valve 108*b*, and downstop engage valve 106*b* are energized, thereby simultaneously causing the lift to rise, the downstop pawl to engage the lift's post, and the locking pin to disengage the locking pin holes in the post. When simultaneous actuation of the manual hold-to-run switch 120 and the lower side of the manual raise/off/lower toggle switch 122 occurs, the solenoids of the lower valve 108*b* and downstop engage valve 110*b* are energized, thereby simultaneously causing the down stop pawl to disengage the lift's post and the lift to lower.

Figure 10:
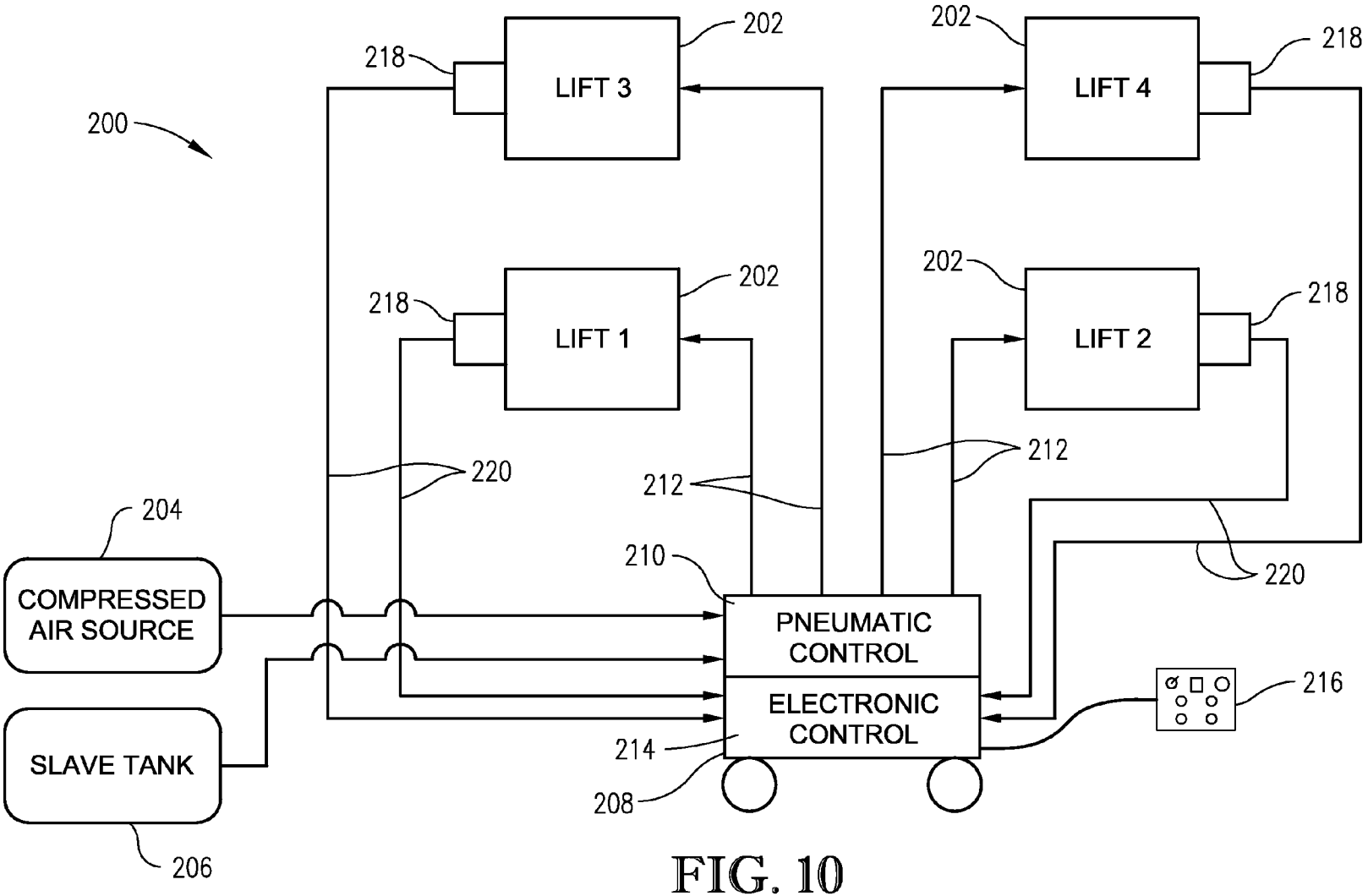
FIG. 10 is a simplified depiction of an alternative pneumatic lift system utilizing a common mobile control unit to control the lifts.

FIG. 10 is a simplified depiction of a pneumatic wheel lift system 200 configured in accordance with an alternative embodiment of the present invention. The pneumatic wheel lift system 200 employs four individual wheel lifts 202. The wheel lifts 202 are powered by compressed air originating from a compressed air source 204 and, optionally, from a slave air tank 206. The slave air tank 206 may be employed in cases where supplemental compressed air is required. The compressed air from the air source 204 and/or slave tank 206 is first supplied to a mobile control unit 208, which includes a pneumatic control system 210. The compressed air is then supplied from the pneumatic control system 210 to each individual wheel lift 202 via pneumatic supply lines 212. The mobile control unit 208 can be a wheeled cart that includes hose reels for storage of the pneumatic supply lines 212 when the pneumatic supply lines 212 are not connected to the wheel lifts 202.

The mobile control unit 208 can also include an electronic control system 214 that interacts with and controls the pneumatic system 210, thereby controlling the wheel lifts 202. The electronic control system 214 can include a handheld control module 216 for receiving input from an operator of the pneumatic wheel lift system 200. The handheld control module 216 can be movable relative to the mobile control unit 208. The handheld control module 216 can include a display, such as an LCD or a touch screen display. In one embodiment, a first portion of the electronic control system is associated with the mobile control unit 208 and a second portion of the electronic control system is associated with the handheld control module 216.

Each wheel lift 202 can be provided with a position indicator 218 for determining the absolute and/or relative heights of the wheel lifts 202. The position indicators 218 can provide the electronic control system 214 with an electronic signal indicating the height of the wheel lifts 202. This electronic signal can be provided via communication lines 220 or wirelessly. The height information provided by the position indicators 218 allows the electronic control system 214 to control the wheel lifts 202 in a manner such the wheel lifts 202 raise and lower in a substantially synchronous, coordinated manner.

Figure 12:
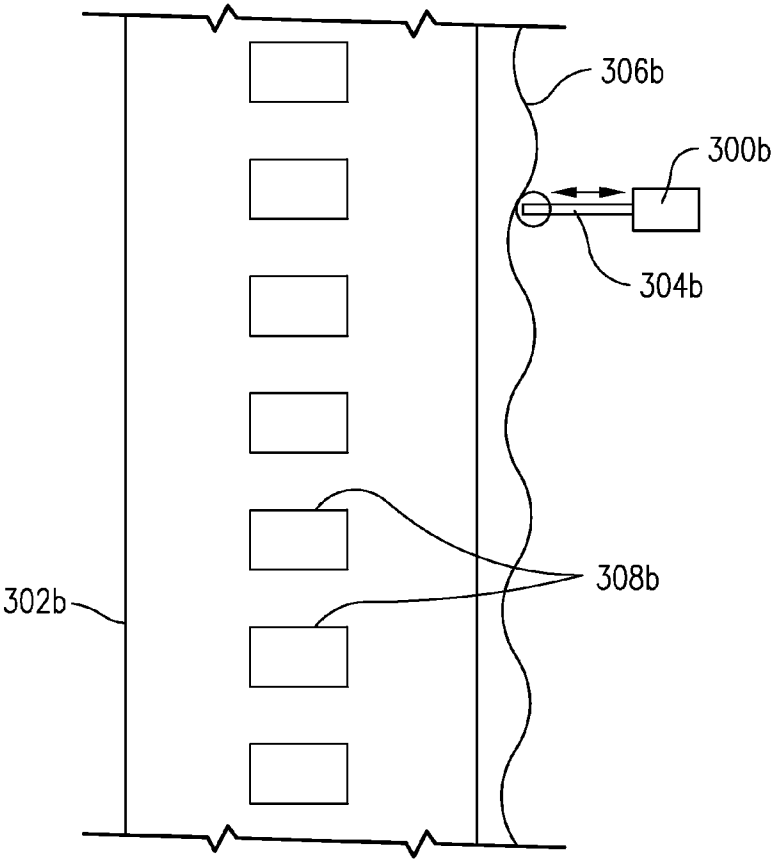
FIG. 12 is a simplified drawing of a limit switch system similar to that of FIG. 11, but employing a vertically varying profile surface other than the downstop lugs to actuate the limit switch.
Figure 11:
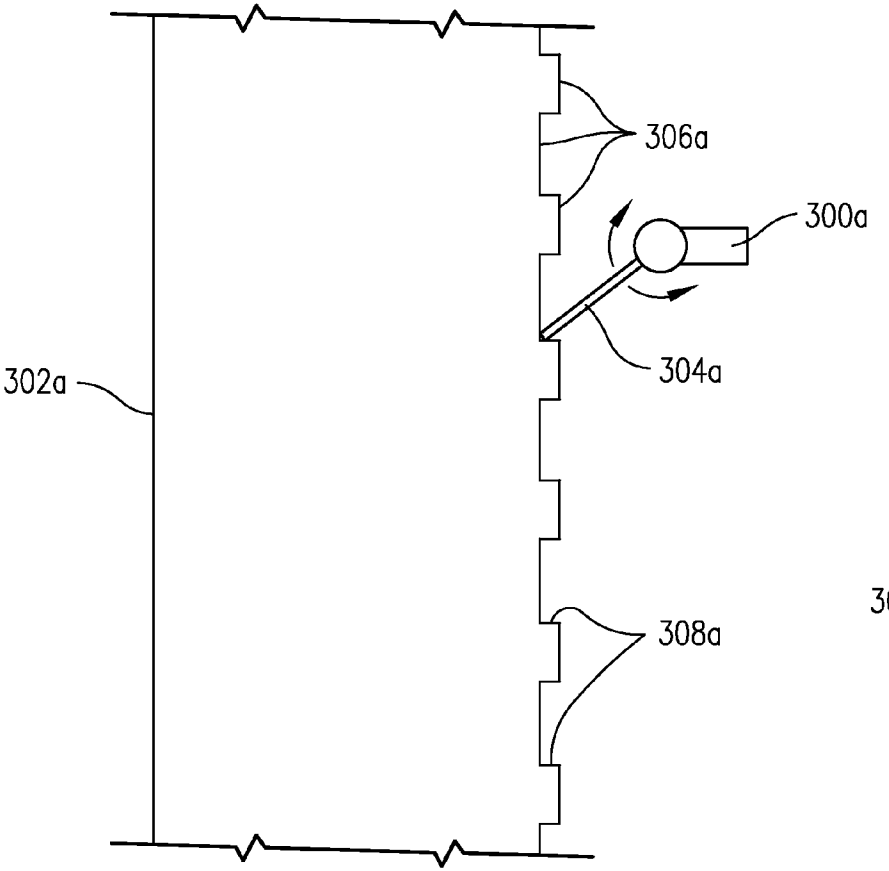
FIG. 11 is a simplified drawing of a limit switch system used to provided an indication of the vertical position of the lift, where the limit switch is actuated by the lift's downstop lugs.

The position indicators 218 depicted in FIG. 10 can be any of a variety of mechanisms for determining the absolute or relative height of the lifts. In one embodiment, the position indicators 218 comprise a string potentiometer. In other embodiments, the position indicators position indicator 218 can comprise a limit switch. FIGS. 11 and 12 provide simplified illustrations of possible configurations for lifts equipped with limit switches.

FIGS. 11 and 12 depict two embodiments of limit switch systems suitable for use with the lift systems of the present invention. In the embodiment depicted in FIG. 11, the electronic limit switch system is coupled to the mechanical downstop system of the lift and senses movement of the downstop system as the cradle assembly is raised relative to the post. In the embodiment depicted in FIG. 12, the electronic limit switch includes a shiftable sensing element that is coupled to the carriage assembly and follows along a vertically varying profile surface as the cradle assembly is raised and lowered relative to the post. These systems are described more detail below.

FIG. 11 shows a rotational limit switch 300*a* coupled to a downstop pawl 304*a*. In this configuration, as the cradle assembly of the lift raises relative to the post 302*a* of the lift, the movement of the downstop pawl 304*a* cause by passing over a vertically varying profile surface 306*a* defined by the downstop lugs 308*a* activates the limit switch. The rotational limit switch 300*a* can communicate with the electronic control system of the lift so that the electronic control system always knows the vertical location of the cradle assembly relative to the downstop lugs 308*a*.

FIG. 12 shows a linear limit switch 300*b* coupled to a rolling follower 304*b*. In this configuration, as the cradle assembly of the lift is raised and lowered relative to the post 302*b* of the lift, the movement of the rolling follower 304*b* caused by passing over a vertically varying cam surface 306*b* activates the limit switch. The linear limit switch 300*b* can communicate with the electronic control system of the lift so that the electronic control system always knows the vertical location of the cradle assembly relative to the vertically varying cam surface 306*b*. This will allow the electronic control system to determine the vertical location of the cradle assembly relative to the downstop lugs 308*b*.

Although the embodiments depicted in FIGS. 1-12 only show pneumatic lifts, it should be understood that certain aspects of the present invention can be advantageously employ in lifts powered by sources other than pneumatic power. For example, certain aspects of the present invention can be employed in lift systems powered by one of more of a pneumatic actuator, a hydraulic actuator, a pneumatic/hydraulic actuator, and/or an electric actuator. Further, although the embodiments depicted in FIGS. 1-12 show a four lift system, the present invention can be applicable to lift systems employing any number of lifts. For example, the present invention can be employed in a lift system having two, four, six, eight, or ten individual lifts. Also, the present invention can be applicable to lifts other than vehicle lifts.

The present invention can also involve methods for retrofitting conventional pneumatic lifts with an electronic control system. Thus, in certain embodiments of the present invention, there is provided a method of converting a manually-coordinating pneumatic vehicle lift system into an automatically-coordinating pneumatic vehicle lift system. The method can include the following steps: (a) providing a first pair of pneumatic lifts, each comprising a base assembly for supporting the pneumatic lift on the ground, a cradle assembly for engaging a wheel of the vehicle, a pneumatically powered actuator for raising the cradle assembly relative to the base assembly, and a mechanical downstop assembly for selectively inhibiting unrestricted downward movement of the cradle assembly relative to the base assembly; (b) providing a lift control system for controlling the pneumatic lifts, where the lift control system comprises a position indication system, a pneumatic control system, and an electronic control system; and (c) coupling at least a portion of the position indication system to the pneumatic lifts so that the position indication system is configured to provide an indication of the absolute height of each cradle assembly and/or the relative height of the cradle assemblies.

Although the invention has been described with reference to the preferred embodiment illustrated in the attached drawing figures, it is noted that substitutions may be made and equivalents employed herein without departing from the scope of the invention as recited in the claims.

The invention claimed is:

1. A wheel-engaging pneumatic lift system for lifting a vehicle relative to the ground using compressed air from an external source, said lift system comprising:

a first pair of pneumatic lifts, each comprising— a base assembly for supporting said pneumatic lift on the ground, a cradle assembly for engaging a wheel of said vehicle, a pneumatic system comprising a pneumatically powered actuator for selectively raising said cradle assembly relative to said base assembly, and an electronic control system comprising a position indicator for providing an indication of the vertical position of said cradle assembly and a wireless communication device a mechanical downstop system for selectively inhibiting unrestricted downward movement of said cradle assembly relative to said base assembly, wherein said mechanical downstop system includes— a pivoting support member configured to pivot relative to said cradle assembly, a pawl fixed to said support member and configured to selectively engage at least a portion of said base assembly, an automatic pivot arm coupled with said support member, such that translation of said automatic pivot arm is configured to actuate said pawl into and out of engagement with said base assembly, a downstop actuator coupled with said cradle assembly and connected to said pivot arm via a linkage member, wherein said downstop actuator is configured to automatically translate said automatic pivot arm, a manual pivot arm coupled with said support member, such that translation of said manual pivot arm is configured to actuate said pawl into and out of engagement with said base assembly, a handle coupled to said manual pivot arm, wherein said handle is configured to manually translate said manual pivot arm, a spring coupled to said manual pivot arm, wherein said spring is configured to bias said manual pivot arm such that said pawl is biased into engagement with said base assembly; and a wireless handheld control module configured for two-way wireless communication with said wireless communication devices of said pneumatic lifts, wherein said wireless handheld control module is configured to wirelessly control raising and lowering of said pneumatic lifts remotely from said lifts, wherein said wireless handheld control module comprises at least one processor programmed to (i) receive vertical position information communicated to said wireless handheld control module by each of said lifts and (ii) automatically maintain said cradle assemblies of said pneumatic lifts at substantially similar heights during raising of said cradle assemblies.

2. The lift system of claim 1, wherein said wireless communication device of each of said pneumatic lifts is configured to communicate vertical position information acquired by said position indicator to said wireless handheld control module.

3. The lift system of claim 1, wherein said wirelessly handheld control module is configured to wirelessly control said mechanical downstop system.

4. The lift system of claim 3, wherein said mechanical downstop system is shiftable between an engaged mode and a disengaged mode, wherein when said mechanical downstop system is in said engaged mode, said pawl is engaged with said base assembly, such that said downstop system prevents unrestricted downward motion of said cradle assembly relative to said base assembly, wherein when said mechanical downstop system is in said disengaged mode, said pawl is not engaged with said base assembly, such that said downstop system does not prevent unrestricted downward motion of cradle assembly relative to said base assembly, wherein said automatic downstop actuator is configured for shifting said mechanical downstop system between said engaged mode and said disengaged mode, wherein said wireless handheld module comprises at least one input device for directly or indirectly activating said automatic downstop actuator so as to shift said mechanical downstop system between said engaged mode and said disengaged mode.

5. The lift system of claim 4, wherein said automatic downstop actuator comprises a pneumatic cylinder.

6. The lift system of claim 1, wherein each of said lifts comprises a height locking system for selectively preventing vertical movement of said cradle assembly relative to said base assembly, wherein said wireless handheld control module is configured to wirelessly control said height locking system.

7. The lift system of claim 6, where said height locking system comprises a shiftable locking pin and an automatic pin actuator for shifting said locking pin between an inserted and a removed position, wherein said wireless handheld module comprises at least one input device for directly or indirectly activating said automatic pin actuator so as to shift said locking pin between said inserted and removed position.

8. The lift system of claim 7, wherein said base assembly comprises an upright post defining a plurality of vertically-spaced locking holes each configured for receipt of said locking pin, wherein said pin actuator and said locking pin are coupled to said cradle assembly for movement therewith, wherein when said locking pin is in said inserted position at least a portion of said locking pin is receive in one of said locking holes, wherein when said locking pin is in said removed position said locking pin is not received in any of said locking holes.

9. The lift system of claim 8, wherein said automatic pin actuator comprises a pneumatic cylinder.

10. The lift system of claim 6, wherein said wireless handheld control module is configured to wirelessly control said mechanical downstop system.

11. The lift system of claim 1, wherein said pneumatic system comprises a plurality of pneumatic valves controlled by said electronic control system.

12. The lift system of claim 1, wherein electronic control system of each of said pneumatic lifts comprises a manual raise and lower switch for raising and lowering said lifts independently of said wireless handheld control module.

13. The lift system of claim 1, wherein said electronic control system comprises an emergency stop (E-stop) switch, wherein said electronic control system is configured to wirelessly communicate an E-stop signal to said wireless handheld control module when said E-stop switch is activated, wherein said wireless handheld control module is configured stop movement of all said pneumatic lifts of said system upon receipt of said E-stop signal.

14. The lift system of claim 1, wherein each of said lifts comprises at least one rechargeable battery for powering said electronic control system.

15. The lift system of claim 1, wherein said wireless handheld control module and said electronic control system each comprises a circuit board and/or a programmable logic controller.

16. The lift system of claim 1, wherein said position indicator comprises a string potentiometer.

17. The lift system of claim 1, wherein said wireless handheld control module comprises a touch screen display.

18. The lift system of claim 1, further comprising a second pair of pneumatic lifts having a substantially similar configuration to said first pair of pneumatic lifts, wherein said wireless handheld control module is configured to wirelessly control both said first and second pairs of pneumatic lifts.

19. The lift system of claim 18, wherein said wireless communication device of each of said pneumatic lifts is configured to communicate vertical position information acquired by said position indicator to said wireless handheld control module, wherein said wireless handheld control module comprises at least one processor programmed to (i) receive vertical position information communicated to said wireless handheld control module by each of said lifts and (ii) automatically maintain said cradle assemblies of said pneumatic lifts at substantially similar heights during raising of said cradle assemblies.

20. A wheel-engaging pneumatic lift system for lifting a vehicle relative to the ground using compressed air from an external source, said lift system comprising:

a first pair of pneumatic lifts, each comprising a base assembly for supporting said pneumatic lift on the ground, a cradle assembly for engaging a wheel of said vehicle, and a pneumatically powered actuator for selectively raising said cradle assembly relative to said base assembly wherein each pneumatic lift further comprises a downstop system for selectively inhibiting unrestricted downward movement of said cradle assembly relative to said base assembly, wherein said downstop system includes— a pivoting support member configured to pivot relative to said cradle assembly, a pawl fixed to said support member and configured to selectively engage at least a portion of said base assembly, an automatic pivot arm coupled with said support member, such that translation of said automatic pivot arm is configured to actuate said pawl into and out of engagement with said base assembly, a downstop actuator coupled with said cradle assembly and connected to said pivot arm via a linkage member, wherein said downstop actuator is configured to automatically translate said automatic pivot arm, a manual pivot arm coupled with said support member, such that translation of said manual pivot arm is configured to actuate said pawl into and out of engagement with said base assembly, a handle coupled to said manual pivot arm, wherein said handle is configured to manually translate said manual pivot arm; and a lift control system for controlling said pneumatic lifts, wherein said lift control system comprises a position indication system for providing an indication of the absolute and/or relative vertical positions of said cradle assemblies, a pneumatic power control system for controlling the supply of compressed air from said external source to said pneumatic lifts, and a wireless handheld control module for controlling, remotely from said pneumatic lifts, said pneumatic power control system based on said indication of vertical position provided by said position indication system, wherein said lift control system is configured to communicate said indication of vertical position of said cradle assemblies to said wireless handheld control module.

21. The lift system of claim 20, wherein said wireless handheld control module is programmed to automatically maintain the cradle assemblies of said pneumatic lifts at similar heights during lifting and lowering of said vehicle.

22. The lift system of claim 20, further comprising a second pair of pneumatic lifts having a substantially similar configuration to said first pair of pneumatic lifts, wherein said lift control system is configured to control both said first and second pairs of pneumatic lifts.

23. The lift system of claim 20, wherein said position indication system comprises at least one relative and/or absolute position detection device selected from the group consisting of an electronic limit switch system, an electronic height sensor, and an electronic level.

24. The lift system of claim 20, wherein said position indicating system comprises one or more string potentiometers.

25. The lift system of claim 20, further comprising a wireless communication system for providing wireless communication between said position indication system and said wireless handheld control module.

26. The lift system of claim 20, wherein said lift control system further comprises an electronic system associated with said pneumatic lifts, wherein said electronic system is configured to communicate wirelessly with said wireless handheld control module.

27. A wheel-engaging pneumatic lift system for lifting a vehicle relative to the ground using compressed air from an external source, said lift system comprising:

a first pair of pneumatic lifts, each comprising a base assembly for supporting said pneumatic lift on the ground, a cradle assembly for engaging a wheel of said vehicle, and a pneumatically powered actuator for raising said cradle assembly relative to said base assembly;

a manually-coordinating lift control system for controlling said pneumatic lifts and, thus, for controlling the vertical positions of the cradle assemblies relative to said base assemblies without the use of electronic automation controls, wherein said manually-coordinating lift control system includes a manual raise/lower switch and a manual hold-to-run switch, and wherein said pneumatic lifts can be raised or lowered by pressing and holding said hold-to-run switch and simultaneously shifting the raise/lower switch to a raise or lower position, respectively; and an automatically-coordinating lift control system for controlling said pneumatic lifts and, thus, for controlling the vertical positions of the cradle assemblies relative to said base assemblies using electronic automation controls, wherein said automatically-coordinating lift control system comprises a position indication system for providing an indication of the absolute and/or relative vertical positions of said cradle assemblies, wherein said pneumatic lifts are capable of selectively operating in either a manual mode of operation or an automatic mode of operation, when said pneumatic lifts are in said manual mode of operation said lifts are controlled by said manually-coordinating lift control system, when said lifts are in said automatic mode of operation said lifts are controlled by said automatically-coordinating lift control system.

28. The lift system of claim 27, a pneumatic power control system for controlling the supply of compressed air from said external source to said pneumatic lifts, and an electronic control system for controlling said pneumatic power control system based on said indication of vertical position provided by said position indication system.

29. The lift system of claim 28, wherein said automatically-coordinating lift control system comprises a plurality of pneumatic valves configured for electronic actuation.

30. A wheel-engaging lift system for lifting a vehicle relative to the ground, said lift system comprising:

a first pair of lifts, each comprising a base assembly for supporting said lift on the ground, a cradle assembly for engaging a wheel of said vehicle, and an actuator for selectively raising said cradle assembly relative to said base assembly; and a lift control system for controlling said lifts, wherein said lift control system comprises a position indication system for providing an indication of the vertical positions of each cradle assembly, an actuator control system for controlling the actuator of each lift, and an electronic control system for controlling the actuator control system based on said indication of vertical positions provided by said position indication system;

a primary compressed air source for providing compressed air to the lifts;

a secondary compressed air source for providing compressed air to the lifts, and a movable cart separated from said lifts, wherein said lift control system comprises a handheld control module, wherein said handheld control module is not rigidly coupled to said lifts or said cart, wherein at least a portion of said lift control system is located on said cart, wherein at least a portion of said lift control system is located in said handheld control module, wherein said actuator control system is located on said cart, wherein said primary and secondary compressed air sources are located separate from said cart, and wherein said primary and secondary compressed air sources are configured to provide compressed air initially to said cart, such that the compressed air can be provided from said cart to said lifts.

31. The lift system of claim 30, wherein said actuator is a pneumatic actuator, a hydraulic actuator, a pneumatic/hydraulic actuator, or an electric actuator.

32. The lift system of claim 30, wherein said actuator is a pneumatic actuator.

* * * * *